United States Patent [19]

Larsson

[11] 4,389,362

[45] Jun. 21, 1983

[54] METHOD FOR MANUFACTURING BILLETS OF COMPLICATED SHAPE

[75] Inventor: Hans-Gunnar Larsson, Västerås, Sweden

[73] Assignee: ASEA Aktiebolag, Västerås, Sweden

[21] Appl. No.: 256,521

[22] Filed: Apr. 22, 1981

[30] Foreign Application Priority Data

Apr. 25, 1980 [SE] Sweden ..... 8003138

[51] Int. Cl.[3] ..... B22F 1/00

[52] U.S. Cl. ..... 264/111

[58] Field of Search ..... 264/111

[56] References Cited

U.S. PATENT DOCUMENTS

| | | | |
|---|---|---|---|
| 2,568,157 | 9/1951 | Lepp et al. | 264/111 |
| 4,142,888 | 3/1979 | Rosmus | 264/111 |
| 4,260,582 | 4/1981 | Kumar et al. | 264/111 |

*Primary Examiner*—James R. Hall

*Attorney, Agent, or Firm*—Watson, Cole, Grindle & Watson

[57] ABSTRACT

A method for manufacturing an article to an intended near final shape and size with powder as the starting material. The powder is placed in a first capsule having the shape of the desired article and a size which allows for a suitable decrease in volume when pressing the powder into a solid body. This first capsule is placed in a second larger capsule and is surrounded on all its sides by a medium which is viscous at the compression temperature. The second outer capsule with its contents is heated, inserted into a press chamber, and surrounded by a readily deformable heat-insulating material such as talcum powder. A piston is inserted into the press chamber and acts to generate a pressure which compresses the material in the first capsule into a homogeneous, solid body.

9 Claims, 1 Drawing Figure

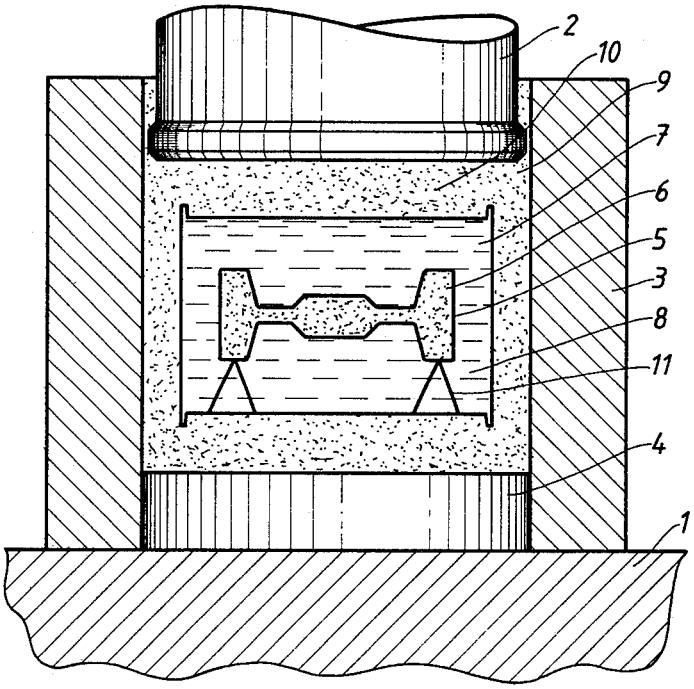
2
10
9
7
6
5
3
8
11
4
1

METHOD FOR MANUFACTURING BILLETS OF COMPLICATED SHAPE

TECHNICAL FIELD AND BACKGROUND ART

A method for manufacturing billets of metal with a metal powder as the starting material is disclosed in U.S. patent application Ser. No. 123,731, filed Feb. 22, 1980. According to this method the metal powder is enclosed as a charge in a capsule, the capsule with the powder charge therein is heated, the heated capsule is inserted into a press chamber and surrounded by a readily deformable layer of a thermally stable powder whose powder grains have a layer structure, and thus slide easily against one another, and which layer has good heat-insulating properties. A piston is inserted into the press chamber and brings about compression of the powder charge and bonding between the powder grains of the charge so that a homogeneous body with the full (or substantially full) theoretical density is obtained. From considerations of price and availability, the readily deformable powder is suitably talcum powder, but other substances having similar properties, such as pyrophyllite, may also be used. The billets manufactured by this method have so far been intended for further machining into end products having a shape and size which are different from those of the billet. The method has not been suitable for the manufacture of billets of a shape and size which are virtually the same as those of the desired end product.

DISCLOSURE OF THE INVENTION

The present invention relates to a method which makes possible the manufacture of a body of a complicated shape and of such a size that only slight machining is required for the final shape and dimensions to be obtained. The material is a powder which is enclosed in a sealed metal capsule and which is subjected to a high, substantially all-sided pressure at the bonding temperature of the powder to be compacted. According to the invention, the powder to be compacted is enclosed in a first capsule having the same shape as that of the end product, but being somewhat larger. The powder is degassed and the capsule is then sealed. This first capsule is then placed in the center of a second larger capsule. This second capsule may have any convenient shape, e.g., a simple shape. The space between the first and second capsules is filled with a pressure-transmitting medium which is viscous at the chosen compacting temperature. The second capsule with its contents is heated to a temperature at which the powder grains within the first capsule may be bonded under pressure, is placed in a press chamber and is surrounded by an easily deformable substance such as talcum powder or pyrophyllite, whereafter a piston is inserted into the press chamber to exert a pressure on the contents. The pressure-transmitting medium surrounding the first capsule is so viscous that it will exert an all-sided isostatic pressure on the first capsule and compress the first capsule, without changing the proportions of the first capsule to any noticable degree. In connection with this compression, at a high temperature, the powder grains within the first capsule are bonded together into a solid body.

The viscous material between the first and second capsules may consist of a salt, a metal or a species of glass, having a melting temperature or a softening temperature at or below the compacting temperature chosen. The compacting pressure should normally be above 1 kilobar, suitably between 3 and 10 kilobar. The compacting temperature is dependent on the material being fabricated. Suitable compacting temperatures are: for steel, high-speed tool steel, 1050°–1100° C., for superalloys 1100°–1250°, for ceramics 1000°–1700° C. and for hard metals 1400°–1500° C. A high temperature results in a high compression even at a relatively low pressure and a short compression time. If the powder temperature is lowered, the same high compression may be obtained by increasing the pressure and/or the compression time. Below a certain temperature, no bonding and compression at all may occur.

The viscous material between the first and the second capsules also constitutes a heat store which surrounds the first capsule and delays the cooling down thereof. This prevents small, projecting portions having a large surface in relation to the enclosed powder volume from being cooled down preferentially. Therefore, all portions of the powder within the capsule will be held at their bonding temperature for a long time, so that a pressure may be applied while bonding conditions still exist. It is therefore possible to press articles having very thin, protruding portions.

BRIEF DESCRIPTION OF DRAWING

The invention will now be described, by way of example, in greater detail with reference to the accompanying drawing, the sole FIGURE of which is a schematic sectional view through a pressure chamber carrying out the method of the invention.

In the drawing 1 designates a press table and 2 a movable piston in a press stand, the rest of which is not shown. On the press table 1 there is placed a press cylinder 3 with a loose inner bottom 4. An inner or first capsule 5 having a shape corresponding to the shape of a finished product is filled with charge 6 of powder. The inner capsule 5 is placed in the center of an outer or second capsule 7 so that it is surrounded on all sides by a pressure-transmitting medium 8 which is so viscous at the compression temperature that it behaves in all essentials as a fluid, thus exerting an all-sided pressure on the inner capsule 5 and compressing the powder charge 6 without changing the shape of the capsule 5 to any mentionable degree. The outer capsule 7 is placed in a press chamber 9 which is formed by the cylinder 3, the bottom 4 and the piston 2. The outer capsule 7 is surrounded on all sides by a layer of talcum powder 10. When the piston 2 is inserted into the cylinder 3, a pressure is exerted on the talcum powder 10. This is propagated to the outer capsule 7. Talcum powder is not an ideal pressure-transmitting medium since it changes the shape of the outer capsule 7 to a certain extent. This imperfection is a considerable disadvantage when it is desired to press an article having a complicated shape in a single operation into near-final shape and dimensions. Because of the pressure-transmitting viscous medium 8, the inner capsule 5 will be subjected to an all-sided pressure so that no deformation, or only an insignificant deformation, of the shape of the capsule 5 occurs during the compression. The medium 8 may be a powder at room temperature or blocks pressed or cast from a powder which together define a cavity adapted to receive the capsule 5. When the medium 8 acquires its viscous properties during the heating, there is a risk that the capsule 5 may sink down or float up. To prevent this, supports 11 may be placed between the outer capsule 7 and the inner capsule 5.

Various modifications may be made to the method as detailed above and all such modifications, within the scope of the following claims, are intended to be included in the invention.

What is claimed is:

1. A method for manufacturing a metal billet from a metal powder charge which includes the steps of enclosing the metal powder charge in a first compressible metal capsule, placing the first capsule containing the metal powder charge in a second compressible capsule, filling the space between the first capsule and the second capsule with a pressure-transmitting medium which will become viscous at a certain compacting temperature which is at least equal to the bonding temperature of the powder charge, heating the second capsule and its contents at least to said compacting temperature, placing the so-heated second capsule in a press chamber, surrounding the second capsule while in the press chamber with a readily deformable thermally insulating substance in powder form, and inserting a piston into the press chamber to generate a compacting pressure therein to produce compression of the second capsule and a compression of the first capsule and thus effect a bonding and compaction of the powder charge in the first capsule to provide the desired billet.

2. A method according to claim 1, in which the thermally insulating substance surrounding the second capsule is selected from the group consisting of talcum powder and pyrophyllite powder.

3. A method according to the claim 1, or claim 2, in which the billet has a predetermined shape and wherein the first capsule has a shape which corresponds to the predetermined shape but is somewhat oversized to take into account its decrease in size due to compaction.

4. A method according to claim 1 or claim 2, in which the pressure-transmitting material between the capsules is at least plastic at the compacting temperature.

5. A method according to claim 3, in which the pressure-transmitting material between the capsules is a material having a softening temperature which is below the compacting temperature selected to be used.

6. A method according to claim 1 or claim 2, in which the compacting pressure is at least 1 kilobar.

7. A method according to claim 5, in which the compacting pressure is 3–10 kilobar.

8. A method according to claim 1 or claim 2, in which the compacting temperature is in the range 1100°–1150° C. when said charge powder is a high-speed tool steel powder.

9. In a method of compacting a metal powder charge contained in a sealed compressible metal capsule by the application thereto of isostatic pressure transmitted via a packing of a readily deformable powder of layer crystal grain structure, the improvement which comprises applying the isostatic pressure to said sealed metal capsule by a viscous fluid pressure generated via a fluid pressure transmitting medium and an outer compressible capsule, the sealed compressible metal capsule being contained within the outer compressible capsule, the fluid pressure transmitting medium being between the sealed compressible metal capsule and the other compressible capsule, and the readily deformable powder surrounding the outer compressible capsule.

* * * * *